US005769598A

United States Patent [19]

MacNeil

[11] Patent Number: 5,769,598

[45] Date of Patent: Jun. 23, 1998

[54] ANTISTACKING WARNING DEVICE AND STACKING DAMAGE DETECTOR

[76] Inventor: David F. MacNeil, 215 E. First St., Hinsdale, Ill. 60521

[21] Appl. No.: 680,206

[22] Filed: Jul. 11, 1996

[51] Int. Cl.[6] ..... B65D 19/38

[52] U.S. Cl. ..... 414/786; 206/459.1; 206/597

[58] Field of Search ..... 116/203; 206/459.1, 206/597; 414/786

[56] References Cited

U.S. PATENT DOCUMENTS

| | | | |
|---|---|---|---|
| 2,601,440 | 6/1952 | Kerrigan | 116/203 |
| 2,825,297 | 3/1958 | Harrison | 116/203 |
| 3,021,813 | 2/1962 | Rips | 116/201 |
| 3,369,521 | 2/1968 | Meeder, Jr. | 116/203 |
| 3,373,716 | 3/1968 | Williams | 116/203 |
| 3,515,091 | 6/1970 | Smith | 116/203 |
| 3,592,156 | 7/1971 | Prachar | 116/203 |
| 3,835,809 | 9/1974 | Sinn, Jr. | 116/203 |
| 4,019,634 | 4/1977 | Bonnot | 206/597 |
| 4,135,472 | 1/1979 | Chesla et al. | 116/215 |
| 4,177,751 | 12/1979 | Rubey | 116/201 |
| 4,986,464 | 1/1991 | Leigh | 206/459.1 X |
| 5,323,729 | 6/1994 | Rubey | 116/200 |

*Primary Examiner*—Janice L. Krizek
*Attorney, Agent, or Firm*—Jefferson Perkins

[57] ABSTRACT

A combination stacking damage detector and antistacking warning device (10) is preferably affixed to the intersection of pallet tying straps (S) to the top of a pallet (P) of goods so as to provide a readily visible warning that a second pallet is not to be stacked upon the first, and also so as to provide a readily visible indication that stacking damage may have occurred. In a preferred embodiment, the device is formed of an integral blank of cardboard and is assemblable into a four-sided pyramid. Holes (22) are provided in the bottom of the sides (14, 15) of the device so that the tying straps (S) may be passed therethrough.

20 Claims, 6 Drawing Sheets

ANTISTACKING WARNING DEVICE AND STACKING DAMAGE DETECTOR

TECHNICAL FIELD OF THE INVENTION

This invention relates in general to damage detection apparatus and antistacking warning devices, and more particularly to a combination antistacking damage detector and warning device for affixation to the top of a pallet of goods.

BACKGROUND OF THE INVENTION

A chronic problem in the shipping industry is the occurrence of damage due to shock or crushing force applied to goods being shipped. In conventional practice, goods are often affixed to a pallet, typically made of wooden crossmembers, and the pallet is then moved about and stored as a unit. The goods are usually affixed to the pallets by steel or plastic strapping which crisscrosses boxes of goods on top of the pallets, or by several sheets of plastic. Two prevalent modes of moving pallets of goods is by truck and rail. Where the goods are not significantly heavy, such as electronic equipment, computers and the like, there is an incentive for the shippers to fill a semitrailer or a rail car with as many pallets of such goods as the volume of the trailer or car permits. In the instance where the pallet of goods has a height that is less than half of the interior height of, e.g., a semitrailer, there is an incentive to stack one pallet of goods on top of another one already loaded into the semitrailer. Where the goods on the bottom pallet are fragile, this will often cause crushing damage to the packages or even to the goods themselves, which therefore causes an economic loss.

In a conventional attempt to prevent shippers from stacking one pallet of goods onto another pallet of goods, labels have been affixed to the fragile pallet of goods bearing a legend like "DON'T STACK". Unfortunately, it has been observed that these two-dimensional labels have been ineffective in preventing stacking in violation of such labels, causing stacking damage.

Numerous devices exist in the prior art for the detection of damage to goods. Most of these are in the nature of inertial detectors, which record a shock or, sharp acceleration felt by the package, and which require movement of one component relative to another component of the detector. Such detectors or impact indicators for containers are shown, for example, by U.S. Pat. No. 2,601,440 issued to J. P. Kerrigan; U.S. Pat. No. 3,369,521 issued to E. A. Meeder, Jr.; U.S. Pat. No. 3,373,716 issued to E. R. Williams; U.S. Pat. No. 3,515,091 issued to D. G. Smith; and U.S. Pat. No. 4,177,751 issued to U. R. Rubey.

U.S. Pat. No. 5,323,729 issued to Rubey discloses a crush indicating device which has a contrasting agent reservoir filled with a contrasting agent, an absorbing wick and a compressible wall. When excessive force is applied downward on top of the crush indicating device, the wick will pick up the contrasting agent, thereby changing the color of the device inside of a transparent window or cover sheet. The Rubey structure, however, is a relatively flat, disklike affair that is not readily visible from several feet away from the container to which it is affixed. Further, the Rubey '729 device shows no method of affixation taking advantage of the crisscrossing straps typically affixing goods to a pallet. A need therefore continues to persist in the shipping industry for an inexpensive, readily visible stacking damage indicator that also can act as an antistacking warning device.

SUMMARY OF THE INVENTION

The present invention provides a combination stacking damage detector and antistacking warning device which is visible from several feet away from a pallet of goods to which one or more of the devices is affixed. The device has a body and a means for affixing the bottom of the body to a top of a pallet of goods. For example, such affixation means can be one or more adhesive strips, or holes cut into the bottom of sides of the body for the receipt and passage therethrough of steel or plastic tying straps that are conventionally used to affix the packaged goods to the pallet. In its original, assembled condition, the body should stand up from the pallet by a distance of at least three inches to be readily visible from several feet away from the pallet; as such, the device will be visible from an operator of a forklift truck or the like.

When more than a predetermined amount of weight is applied to the top of the device, it will permanently deform, and will thus give a visual indication to the observer that an object has been stacked on top of the pallet of goods, When the addressee of the pallet of goods receives it, he or she will note the condition of the devices, and any damage to the goods occurring in shipment can be more readily attributed to the shipper.

According to another aspect of the invention, the antistacking device and damage detector can consist of a polyhedral solid with a plurality of faces. One or more of the sides of this polyhedron can have a wording or another indicium printed or painted thereon warning the shipper not to stack any objects on top of the pallet of goods, such as "DON'T STACK. " Preferably, the device takes the form of a three- or even more preferably a four-sided pyramid.

In a preferred embodiment, holes are formed in each of the sides of the device adjacent bottom margins of those sides. As an aid to forming the holes, bottom flaps are provided which can be folded under when the device is in an assembled condition.

The material from which the device is constructed should be more plastic than elastic, that is, when it deforms or crushes, it should stay that way at least to a readily apparent extent. Further, it is preferred that the device be built of materials which, when the device is crushed or misused, will not be able to be rehabilitated by a shipper. Cardboard is a preferred material for its compactness in a stored, unassembled condition, its ease of construction into the assembled form of the invention, and for its frangibility.

A principal technical advantage of the invention inheres in its combination of (1) an antistacking warning device which is visible from several feet away from the pallet, and (2) a damage detector. The antistacking warning device and stacking damage detector therefor provides a significant deterrent to mishandling of a pallet of goods during shipment.

BRIEF DESCRIPTION OF THE DRAWINGS

Further aspects of the invention and their technical advantages will be discerned with reference to the following detailed description when taken in conjunction with the drawings, in which like characters number like parts and in which.

DETAILED DESCRIPTION OF THE INVENTION

Figure 1:
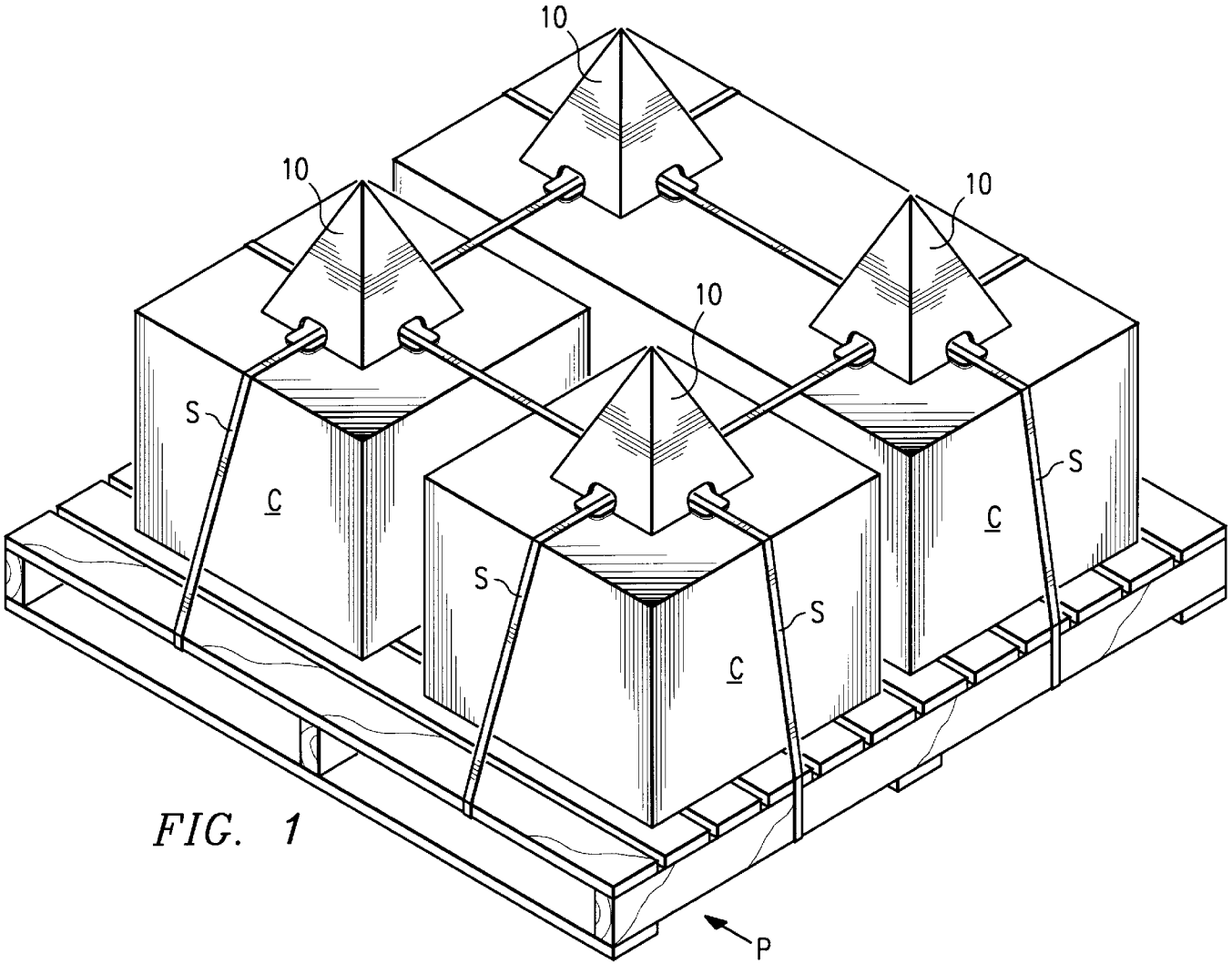
FIG. 1 is an isometric view of a pallet of goods with several of the devices according to the invention affixed to the top thereof.

In FIG. 1 there is seen a pallet P of goods, on which have been placed cardboard containers C; typically, several such containers will be placed on a single pallet P. Conventionally, the containers C are affixed to the pallet P by straps S in both a lengthwise and a widthwise direction. The number of straps S will vary according to the size of the pallet and the tendency of the containers C to shift off of the pallet P. Typically, the straps S are formed of steel or plastic. In an alternative binding method, the containers C may be affixed to the pallet P by one or more sheets of plastic (not shown).

A plurality of combination antistacking warning and stacking damage detector devices 10 are shown affixed to the top of the pallet P at selected (here, all) intersections of the widthwise and lengthwise straps S. The number of devices 10 used on any particular pallet depends on its size. For small pallets P, only one antistacking device 10 may be necessary; for pallets P of a more typical size, four antistacking devices 10 should be employed. For particularly large pallets (not shown) P, one antistacking device should be affixed to the top of the pallet inside each unit of surface area to be protected; thus, for example, an antistacking device 10 may be affixed at that intersection of straps which is closest to each corner of the pallet, plus one device located in the middle of the pallet to prevent the stacking of a second pallet in a position such that it would not touch the four corner devices.

Figure 2:
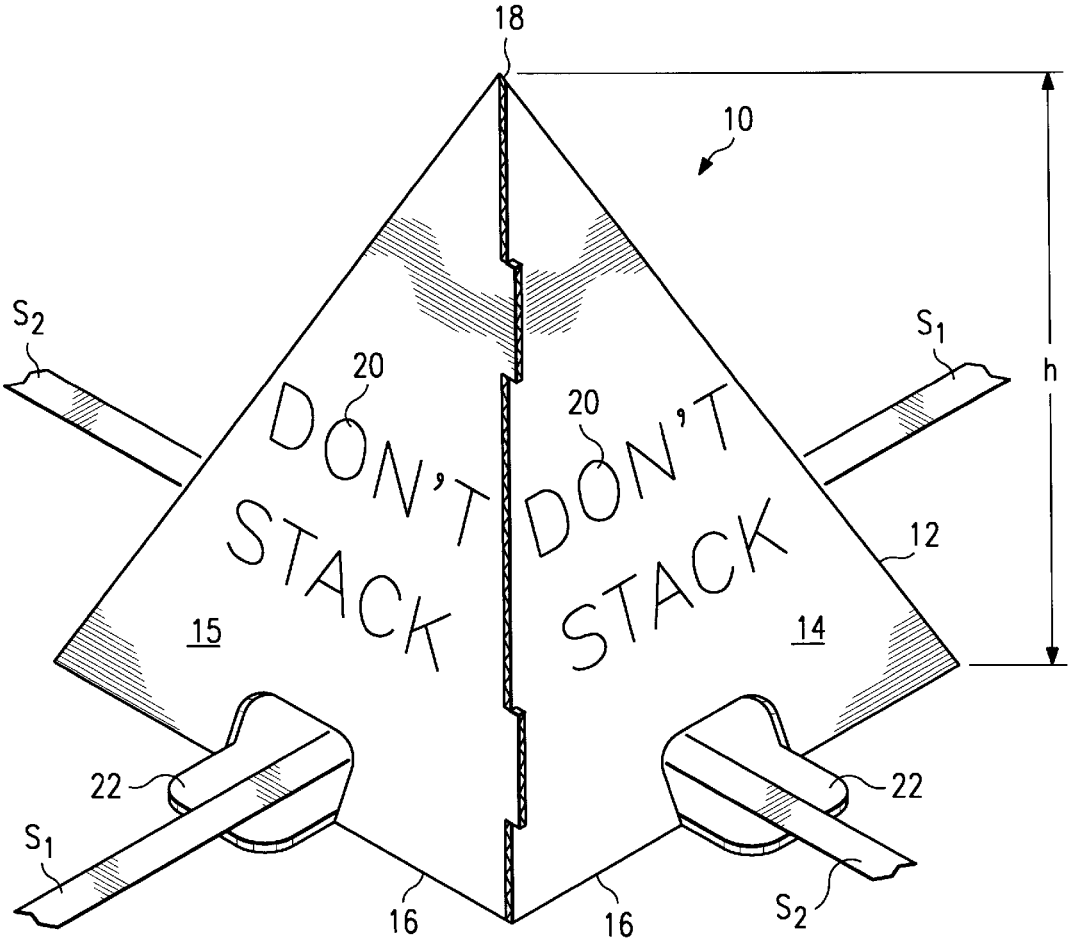
FIG. 2 is a close-up isometric view of a combination antistacking warning device and damage detector according to the invention.

FIG. 2 illustrates one of the antistacking devices 10 in more detail. A preferred form of the antistacking device 10 is a pyramid, as shown. The antistacking device 10 has a body 12 with a plurality of faces 14 and 15 that extend from a bottom margin 16 to a top 18. It is preferred that each of the faces 14 and 15 visible to handlers of the pallet have warning indicia 20 thereon in a prominent size. For example, as shown such indicia could be the words "DON'T STACK." In an alternative embodiment, the warning indicia 20 could be in several languages, one or more languages per face 14, 15. The languages of the warning phrases may be selected according to the probable nationalities of the shippers. For use in Mexico and the Southwestern United States, for example, warnings in English and Spanish may be printed; for use in Canada, warnings in French and English may be used; and for use on pallets that have overseas origins and/or destinations, the languages of the source and of the destination country may be used.

In an assembled condition, the body 12 has a height h, measured in a direction perpendicular to its base, which is preselected according to considerations of compactness of size as stored in an unassembled condition and, in a countervailing direction, visibility to the shipping personnel when the device is in an assembled condition. The height h should be at least 3 inches tall to accord it sufficient visibility from several feet away; it is preferred that the height h be between 8 and 12 inches, and in a particularly preferred embodiment h is approximately 9¾ inches.

As assembled, each of the faces 14, 15 has a hole 22 formed in the bottom portion thereof adjacent its bottom margin 16. These holes 22 are sized to receive a tying strap $S_1$ or $S_2$; the device 10 is affixed to the pallet at the time the containers are strapped thereto. Affixing the devices 10 to the top of the pallet P using the straps $S_1$ and $S_2$ is a particularly preferred method, as the devices 10 will not then be capable of being removed without their destruction, or at least not without extraordinary measures by the shippers. Thus, the antistacking devices 10 preserve the integrity of the shipment much in the way that a wax seal preserves the integrity of a sealed-shut document. The bottom of the device 10 (see FIG. 3) may be affixed to the top of the pallet P by adhesive strips 68 or the like; such a method of affixation is useful where the affixation method used to affix the containers C to the pallet P is plastic wrap.

Figure 3:
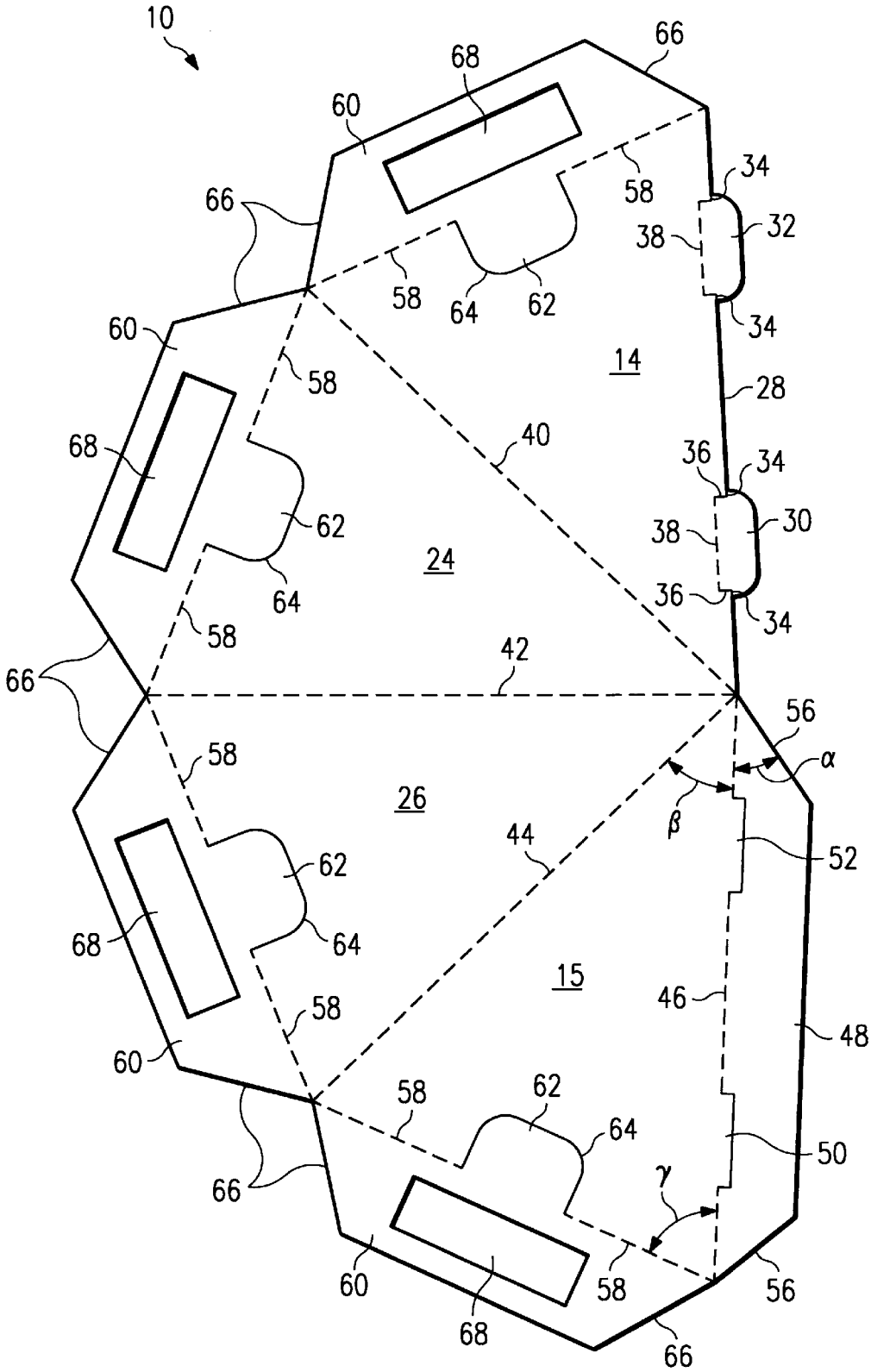
FIG. 3 is a plan view of a cardboard blank, showing the device in an unassembled condition.

Preferably, the device 10 is assembled from a sheet of relatively thin, flat material, such as cardboard. Such a sheet of material is shown in FIG. 3, which is a plan view of a device 10 in its unassembled condition. In the preferred embodiment, the device 10 takes the form of a four-sided pyramid which will thus have isosceles triangular faces 14, 24, 26 and 15, respectively. A first side margin 28 of the triangular face 14 is equipped with a pair of tabs 30 and 32; the size and extent of the tabs 30 and 32 can be varied according to the desired strength of the closure comprising them. Each of the tabs 30 and 32 has small slots 34 formed colinearly with margin 28 as is well known in cardboard joining practice. With respect to each of the tabs, two parallel cut lines 36 proceed inwardly from the generally linear margin 28 by a small distance, and a fold or score line 38 joins the terminus of these two cut lines 36. The degree of recess of the fold lines 38 from the generally linear first side margin 28 is preferably the same as the thickness of the sheet of material from which the device 10 is to be constructed.

A second side margin 40 of the first face 14 is a score or fold line, and is also a first side margin of an intermediate triangular face 24. An opposed, second side margin 42 of the intermediate triangular face 24 is also the first side margin of a fourth triangular face 26; this in turn has a second side margin 44 that is the same as the first side margin of a last triangular face 15. The margins 40, 42 and 44 are score or fold lines to aid in the assembly of the flat, unassembled piece of material into a pyramidal shape as shown in FIG. 2. A second side margin 46 of the triangular face 15 has a side closure flap 48 that extends at least by a distance sufficient to help define a pair of slots 50 and 52, the position and number of which are selected to mate with respective ones of the tabs 30 and 32. The slots 50 and 52 are formed to be adjacent the side margin 46 and their width and length are preselected such that tabs 30 and 32 will snap into them. In one embodiment, the side or closing flap 48 may be used as a gluing surface so that it may be affixed to one or the other sides of the triangular face 14; where the flap 48 is to be glued to the triangular face 14, the device will typically be preassembled prior to its distribution to prospective users. Because of their open bottoms, devices 10 may be preassembled and stacked on top of one another for ease in storage and distribution.

Side margins 56 of the side closing flap 48 are acutely angled, and form an angle a with the first side margin 46 of face 15 that is at least as acute and preferably is more acute than, the smaller of an apical angle $\beta$ and a base angle $\gamma$ of the faces 15 or 14.

Each of the isosceles triangular faces 14, 24, 26 and 15 has a bottom margin 58 that joins the respective side margins 28, 40; 40, 42; 42, 44 and 44, 46 of the triangular faces. Adjacent each one of the bottom margins 58 is a bottom flap 60. The bottom margins 58 are fold or score lines. Interrupting each one of the bottom margins 58 is a cutout 62 which is formed, for example, by a U-shaped cut 64. Each cutout 62 is formed to be continuous with a respective bottom flap 60. When each of these is punched out in the manner shown in FIG. 2 and the corresponding flap 60 folded, a hole 22 will result. One of the purposes of the bottom flaps 60 is to form a bottom limit of each hole. Each of the bottom flaps 60 has a side margin 66 at a sufficiently acute angle to a respective margin 58 such that, when the device is fully assembled and the flaps 60 are folded inward, there will be no overlap of margins 66, but rather that the margins 66 will form an annular square or frame.

To cover the common instance where the device 10 will be used to protect the top surface of a pallet wrapped with plastic, the flaps 66 also preferably each have an adhesive strip 68 affixed thereto, which may be of a conventional peel-off type. Preferably, each of the adhesive strips 68 are of the padded type so as to provide adhesive surface area even on a somewhat nonplanar container surface. While the flaps 60 may be folded underneath the body 12, as is shown in FIG. 2, alternatively they may be folded outwardly such that an opposite side of them will be presented downward; such an alternative disposition would allow devices 10 to be stacked in a preassembled condition. In one embodiment, adhesive strips 68 would be affixed to both opposed faces of the flaps 60 so that the flaps may be turned inwardly or outwardly at the user's choice.

Figure 4:
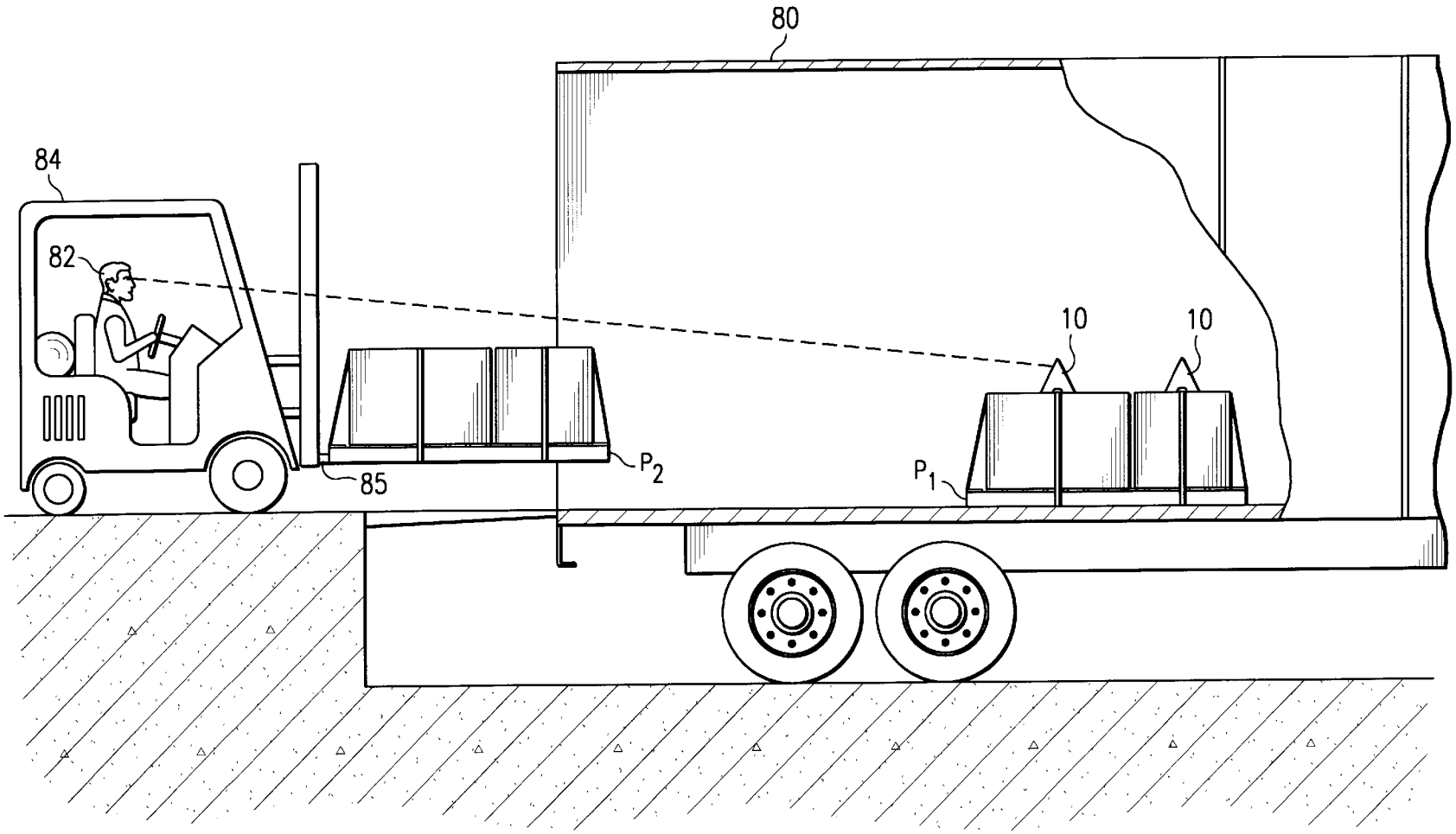
FIG. 4 is a part elevational, part sectional view showing the utility of the invention as an antistacking warning device.

FIG. 4 shows the antistacking devices 10 in use. A pallet $P_1$ having a top to which several devices 10 have been affixed has already been loaded into a semitrailer 80, a side of which has been broken away to show interior detail. A forklift operator 82 is sitting on a forklift 84 and is moving a second pallet $P_2$ of goods into the back of the semitrailer 80. As explained above, the natural penchant of the operator 82 (or his or her employer) is to fill as much of the interior volume of the semitrailer 80 as possible; without the antistacking warning devices 10 being in place, his or her natural tendency would be to take the pallet $P_2$ and stack it immediately on top of the pallet $P_1$. However, from a position which is significantly remote (such as several feet) from the pallet $P_1$, the forklift operator 82 discerns the antistacking devices 10 and the NO-STACK indicia (see FIG. 2) labelled thereon. He or she therefore knows not to place the pallet $P_2$ on top of the pallet $P_1$ but rather along side of it. In this way, stacking damage to the goods affixed to pallet $_1$, which goods may be relatively fragile items, is avoided. The usual interposition of the fork 85, pallet $P_2$ and a portion of forklift 84 between operator 82 and pallet $P_1$ means that the antistacking devices must be large enough to be readily visible several feet away. Visibility from at least ten feet is recommended. The interiorly mounted and/or small devices shown in the prior art would be ineffective in preventing stacking damage; they typically only record the occurrence of such damage. This is why placement e.g. on top of pallet $P_1$ in a visibly prominent position is important.

Figure 5:
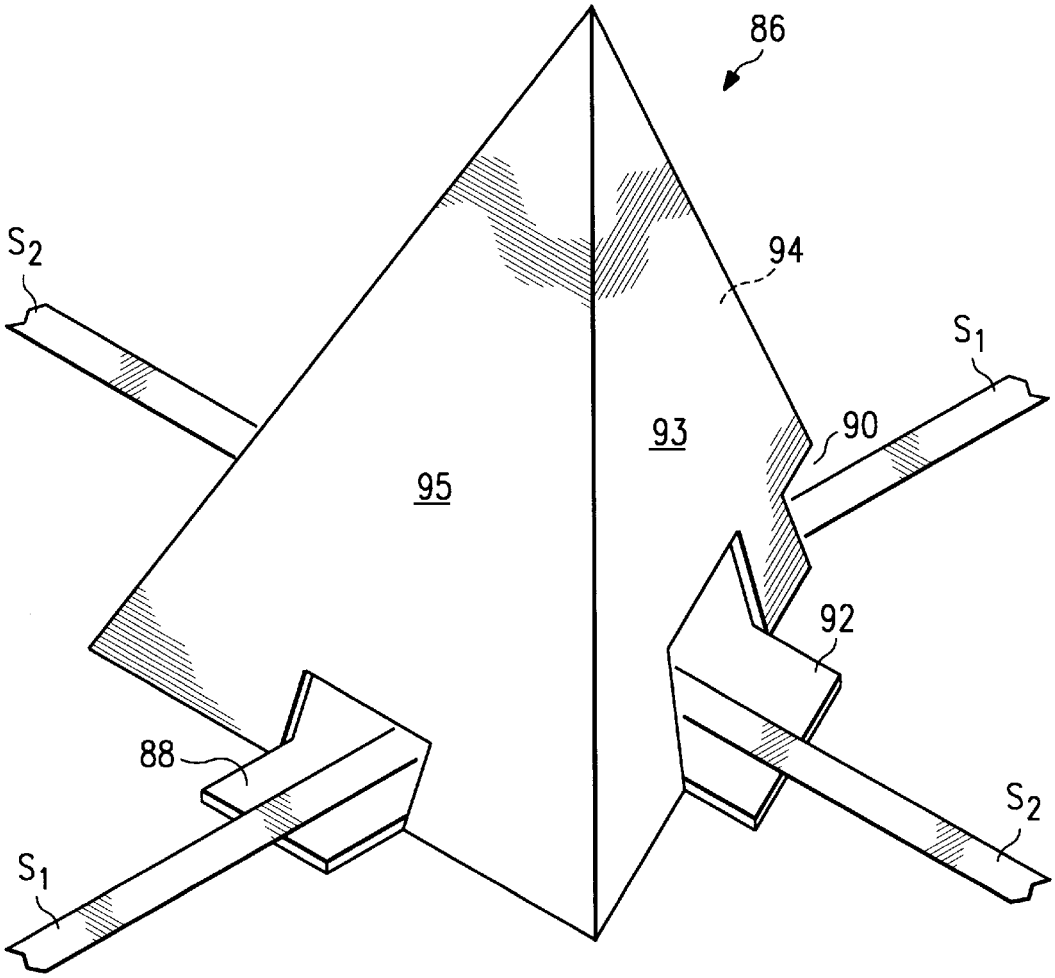
FIG. 5 is an alternative embodiment of the invention, showing a triangular-based pyramid.

FIG. 5 illustrates an alternative embodiment of the invention, in which an antistacking device indicated generally at 86 takes the form of a three-sided pyramid. It has cutouts 88, 90 and 92 positioned so as to receive intersecting straps $S_1$ and $S_2$ as before. Cutout 90 is formed at the intersection of two faces 93 and 94. Cutout 88 is formed at the middle of the bottom margin of a third face 95. Cutout 92 and a matching cutout (not shown) are formed on the bottom margin of faces 92 and 93 so as to be spaced from cutout 90.

Figure 6:
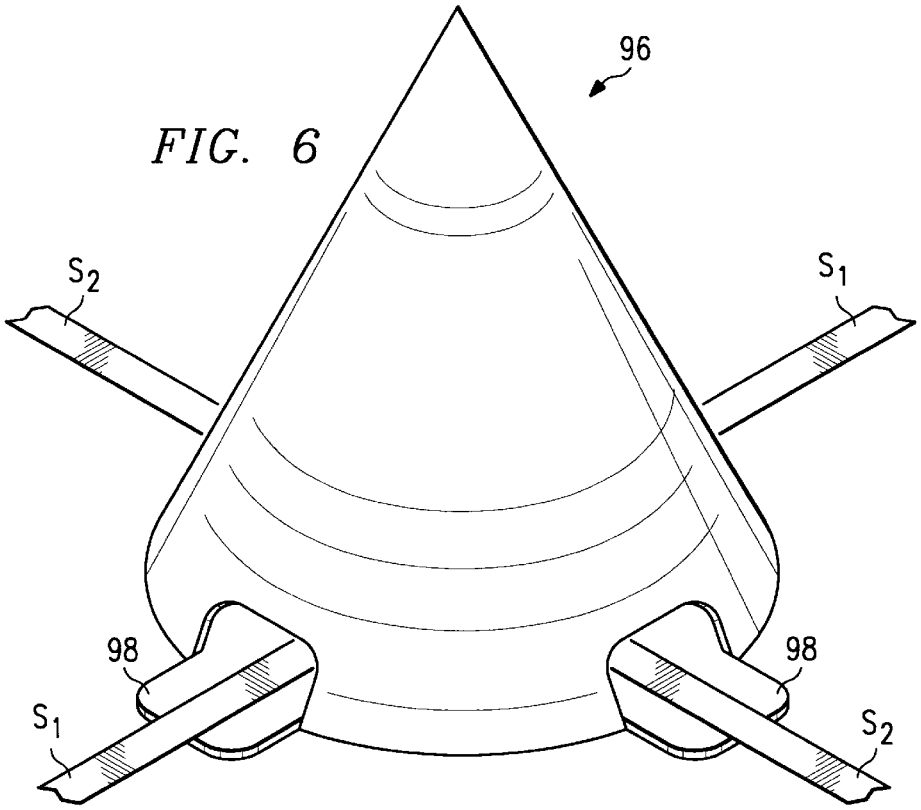
FIG. 6 is another alternative embodiment of the invention, showing a cone form.

FIG. 6 illustrates yet another embodiment of the invention, this time a cone 96. The cone 96 may be formed of a relatively flexible piece of material that may have bottom margins or flaps (not shown) that are of a sufficient size to define the bottom margins of respective holes 98.

The device 10 is designed such that when it is in an assembled condition and as affixed to the top of a pallet, it will crush or fail upon the application of a predetermined amount of weight or force to its top.

There are several specifications of the devices which can be varied to determine the device's predetermined weight loading limits. For example, there will be an optimum slope of the pyramidal sides at which the devices may hold a maximum of weight without crushing. Increasing the height or decreasing the slope from this optimum angle may cause the antistacking device to fail more rapidly than it otherwise would. To weaken the device, and therefore lower its predetermined weight, the thickness of the material or its composition may be altered, or the methods of joining it together may be made less adequate, such as reducing the number of the tabs 30 and 32. To increase the predetermined crushing weight limit of the antistacking device 10, the thickness of the material can be increased and/or its methods of joining the isosceles triangular faces 14, 15, 24 and 26 (FIGS. 2–3) may be augmented, such as increasing the number of the tabs 30 and 32 and/or gluing the side flap 48 to the face 14. For a particularly strong antistacking device, provisions can be made for joining the bottom flaps 60 together so that there will be additional resistance to flattening out the pyramid shape.

Figure 7:
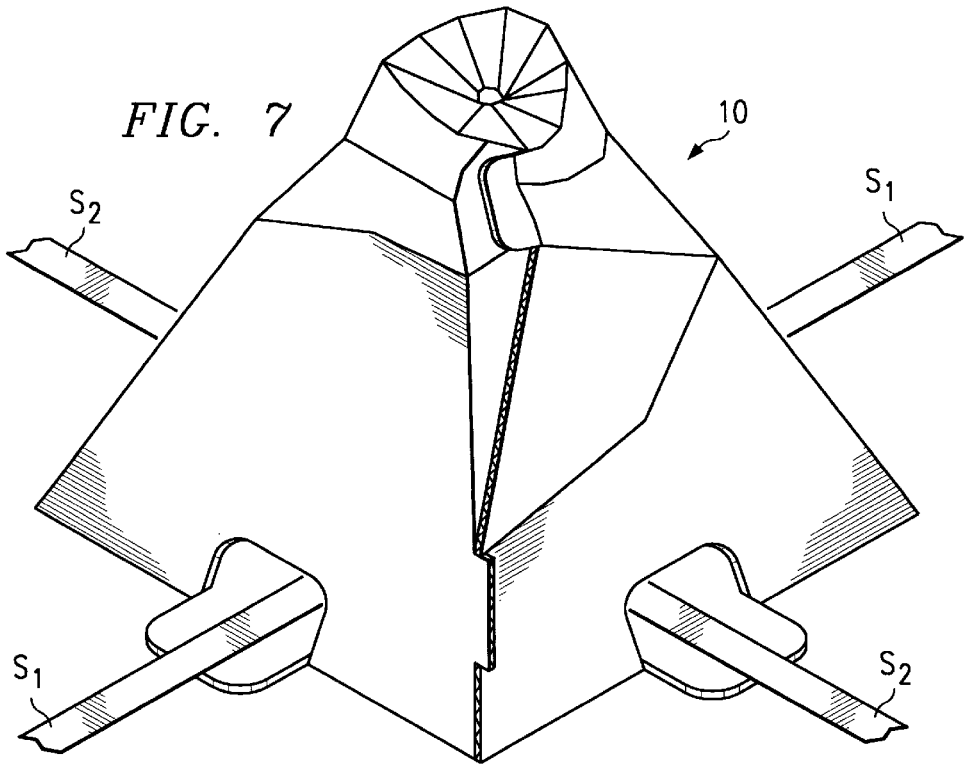
FIG. 7 is an antistacking device according to the invention which has been affixed to a pallet, showing one mode of failure caused by placing more than a predetermined weight on the top thereof.

FIG. 7 is an isometric view of a device 10' in a failed condition. As explained above, it is preferred that the device 10 be formed of a plastic rather than an elastic material, such that any deformation that it suffers due to putting too much weight on it will cause irreversible and quickly visible damage. In one embodiment, the exterior face of the pyramidal device 10' may have a coating on it (not shown) which splits when the surfaces 14, 15, 24 and 26 (FIGS. 2 and 3) are deformed by more than a predetermined amount. As shown, the device 10' will remain affixed to the pallet even after it has suffered damage; reinforcements can be made to the holes 22 to ensure that the device, as evidence, of maltreatment, remains. In one embodiment of the device, the lower portion thereof can be made of a quite rugged material that is very resistant to its removal, while the top thereof may be made of a relatively flimsy material that irreversibly collapses upon application of a predetermined force.

Other shapes of the device 10 may also be contemplated. For example, instead of the polyhedral or conical shapes shown, the device 10 can take the form of an upstanding figurine. Further, assembly of the device 10 out of a cardboard blank is only one of several fabrication methods; in another form (not shown) the device may be blow-molded or injection molded out of a suitable plastic material.

While the device of the invention has been described in terms of protecting a pallet of goods, it can as easily protect any other object to be shipped or group of objects, where such object or objects is liable to be damaged if other objects or goods are stacked on top of them.

In summary, a combination antistacking warning device and stacking damage detector has been shown and described. The device is affixable to the top of a pallet of goods at the intersection of tying straps, and may alternatively be affixed thereto using adhesive tabs. The upstanding device is visible from several feet away so as to give a readily apparent warning to handlers of a pallet of goods and also to give a readily apparent indication that damage to the pallet of goods has been sustained in contravention of antistacking instructions.

While particular embodiments have been illustrated in the above detailed description, the invention is not limited thereto but only by the scope and spirit of the appended claims.

What is claimed is:

1. A combination stacking damage detector and antistacking warning device, comprising:

a body having a bottom and a top;

means for affixing the bottom of the body to a top of an object to be shipped;

a height of said body measured in a direction perpendicular to said bottom from said bottom to said top, said height being at least three inches, said body normally upstanding from said object when less than a predetermined force is applied on said top toward said bottom; and said body having at least one upstanding wall between the top and the bottom, the upstanding wall permanently deforming responsive to at least said predetermined force being applied to said top toward said bottom, said body when deformed giving a visual indication to an observer located several feet away from said body that an item having a weight that equals or exceeds said predetermined force has been applied to said top of said object.

2. The device of claim 1, wherein said object is a pallet of goods.

3. The device of claim 1, wherein said height is selected from the range of about 8 inches to about 12 inches.

4. A combination stacking damage detector and antistacking warning device, comprising:

a body having a bottom and a top and at least one side, the side having a bottom margin, a bottom flap of the bottom joined to the bottom margin of the side;

the side and the bottom flap defining and bounding a hole at the junction of said bottom with said at least one side, said hole sized to receive a tying strap therethrough so as to affix said device to a top of an object to be shipped;

said body permanently crushing responsive to at least a predetermined force being applied to said top of said body toward said bottom, said body when crushed giving a visual indication that an item having a weight that equals or exceeds said predetermined force has been applied to said top of said object.

5. The device of claim 4, wherein said object is a pallet of goods, said typing strap used to affix at least one container to said pallet.

6. The device of claim 4, wherein said body is formed of cardboard.

7. The device claim 4, wherein said bottom flap is integral with said side.

8. The device of claim 4, wherein said body is formed of a plurality of sides including said at least one side, said body having at least two opposed holes including said hole for the passage therethrough of said tying strap.

9. A combination stacking damage detector and antistacking warning device formed from a single sheet of flat, relatively thin material, comprising:

a first triangular face having first and second side margins, a joining flap joined to said first side margin of said first triangular face;

a second triangular face having first and second side margins, said second side margin of said second triangular face mateable with said joining flap when said device is assembled;

at least one additional triangular face interposed on said single sheet between said first triangular face and said second triangular face, said at least one additional face having a side margin adjoining a preselected one of said second side margin of said first triangular face and said first side margin of said second triangular face;

at least said first and second triangular faces having a bottom margin, a bottom flap attached to each of said bottom margins, for each of said first and second triangular faces, a cutout formed in the triangular face adjacent a bottom margin thereof so as to create a hole adaptable to receive a tying strap therethrough; and said device assemblable into a pyramidal solid having a bottom including said bottom flaps and a top, said device affixable to an object to be shipped by passing at least one tying strap through one or more of said holes, said device permanently crushing upon the application of at least a predetermined force to said top in the direction of said bottom to thereby indicate the possibility of stacking damage to said object.

10. The device of claim 9, wherein said object is a pallet of goods.

11. The device of claim 9, and further comprising a fourth triangular face, a first side margin of said fourth triangular face adjoining said second side margin of said first triangular face, a second side margin of said fourth triangular face adjoining a side margin of said additional triangular face.

12. The device of claim 9, wherein a respective bottom flap adjoins a bottom margin of each of said triangular faces, a respective cutout formed in each of said triangular faces to adjoin a respective one of said bottom flaps.

13. The device of claim 9, wherein at least one slot is formed on said first side margin of said first triangular face, a tab formed on said second side margin of said second triangular face which is insertable into said slot when said device is assembled.

14. The device of claim 13, wherein a plurality of said slots are formed on said first side margin of said first triangular face, a like plurality of tabs formed on said second side margin of said second side face which are insertable into respective ones of said slots upon assembly of said device.

15. A method for preventing stacking damage to a pallet of goods and for indicating such damage, comprising the steps of:

providing an upstanding body of a device which will crush upon the application of at least a predetermined force on a top of the body toward a bottom thereof;

forming antistacking warning indicia on at least one upstanding side of the body;

affixing the device to a top of the pallet of goods such that the body will be clearly visible to a handler of the pallet of goods; and if an object of more than a predetermined weight is placed on top of the pallet of goods, crushing the body of the device in response to said weight to give an indicium of damage.

16. A combination stacking damage detector and antistacking warning device, comprising:

a body having a bottom and a top and taking the form of a polyhedron, at least one side of the polyhedron having warning indicia placed thereon;

means for affixing the bottom of the body to the top of an object to be shipped;

a height of said body measured in a direction perpendicular to said bottom from said bottom to said top, said height being at least three inches, said body normally upstanding from said object when less than a predetermined force is applied on said top toward said bottom; and said body permanently deforming responsive to at least said predetermined force being applied to said top toward said bottom, said body when deformed giving a visual indication to an observer located several feet away from said body that an item having a weight that equals or exceeds said predetermined force has been applied to said top of said object.

17. The device of claim 16, wherein said body is a pyramid.

18. The device of claim 17, wherein said body is a three-sided or a four-sided pyramid.

19. A combination stacking damage detector and antistacking warning device, comprising:

a body having a bottom and a top;

adhesive strips, affixed to the bottom of the body, for affixing the bottom of the body to the top of an object to be shipped;

a height of said body measured in a direction perpendicular to said bottom from said bottom to said top, said height being at least three inches, said body normally upstanding from said object when less than a predetermined force is applied on said top toward said bottom; and said body permanently deforming responsive to at least said predetermined force being applied to said top toward said bottom, said body when deformed giving a visual indication to an observer located several feet away from said body that an item having a weight that equals or exceeds said predetermined force has been applied to said top of said object.

20. A combination stacking damage detector and antistacking warning device, comprising:

a body having a bottom and a top, at least one side adjoining said bottom;

means for affixing the bottom of the body to the top of an object to be shipped comprising a hole formed in said at least one side adjacent said bottom, said hole sized to receive a tying strap therethrough;

a height of said body measured in a direction perpendicular to said bottom from said bottom to said top, said height being at least three inches, said body normally upstanding from said object when less than a predetermined force is applied on said top toward said bottom; and said body permanently deforming responsive to at least said predetermined force being applied to said top toward said bottom, said body when deformed giving a visual indication to an observer located several feet away from said body that an item having a weight that equals or exceeds said predetermined force has been applied to said top of said object.

* * * * *